US005748757A

United States Patent [19]

Kubli et al.

[11] Patent Number: 5,748,757

[45] Date of Patent: May 5, 1998

[54] COLLAPSIBLE IMAGE DERIVED DIFFERENTIAL MICROPHONE

[75] Inventors: Robert Alfred Kubli, Milford; James Edward West, Plainfield, both of N.J.

[73] Assignee: Lucent Technologies Inc., Murray Hill, N.J.

[21] Appl. No.: 579,528

[22] Filed: Dec. 27, 1995

[51] Int. Cl.[6] ..... H04R 25/00

[52] U.S. Cl. ..... 381/168; 381/160; 381/91; 381/169

[58] Field of Search ..... 381/168, 169, 381/181, 91, 122, 92, 94, 158, 160; 367/119, 135

[56] References Cited

U.S. PATENT DOCUMENTS

| | | | |
|---|---|---|---|
| 4,206,324 | 6/1980 | Horikawa et al. | 179/150 |
| 4,293,742 | 10/1981 | Sato et al. | 179/178 |
| 4,675,906 | 6/1987 | Sessler et al. | 381/92 |
| 4,742,548 | 5/1988 | Sessler et al. | 381/92 |
| 4,856,070 | 8/1989 | Britton et al. | 381/169 |
| 4,965,775 | 10/1990 | Elko et al. | 367/119 |

OTHER PUBLICATIONS

"Image-Derived Second-Order Differential Microphones", Elko, G.W., West, J.E., Kubli, R.A., *J. Acoust. Soc. Am.* 95(4), Apr. 1994, pp. 1991–1997.

*Primary Examiner*—Sinh Tran
*Attorney, Agent, or Firm*—Kenneth M. Brown

[57] ABSTRACT

An acoustic signal receiving apparatus comprising a housing having an acoustically reflecting surface and a directional acoustic sensor unit having first-order gradient characteristics. The sensor unit is coupled to the housing with use of a retractable member having a retracted position and an extended position. When the member is extended, the sensor unit is positioned relative to the reflecting surface such that the acoustic interaction between the sensor unit and the reflecting surface causes the output of the sensor unit to have second-order gradient response characteristics. In accordance with one illustrative embodiment, in a notebook computer with a "flip-back" lid, the sensor element automatically extends to the desired position when the lid is opened, and automatically retracts to be flush with the housing surface when the lid is closed.

30 Claims, 3 Drawing Sheets

COLLAPSIBLE IMAGE DERIVED DIFFERENTIAL MICROPHONE

FIELD OF THE INVENTION

The present invention relates to the field of directional microphones and more particularly to image derived differential microphones which are collapsible when not in use.

BACKGROUND OF THE INVENTION

In many devices such as notebook computers or hand-held tablet computers intended to provide, for example, both computing and telecommunication functions, there are serious space limitations for microphone and loudspeaker placement and installation. Not only is space limited, but when adequate space can be found it is often in places undesirable for microphone placement. Moreover, the use of conventional omnidirectional microphones often results in an unacceptable signal-to-noise ratio (SNR). The unwanted noise may include, for example, noise generated by the device itself, as well as room reverberation and environmental noise. This latter consideration suggests the use of directional microphones for these applications. Unfortunately, directional microphones often require even more space than omnidirectional microphones, and their use may impose additional constraints on microphone location in order to achieve acceptable performance levels.

In U. S. Pat. No. 4,965,775 issued to G. W. Elko et al. on Oct. 23, 1990, and assigned to the assignee of the present invention, a microphone having second-order gradient characteristics was obtained when a directional microphone or other sensor element having first-order gradient characteristics was positioned in proximity to a planar reflecting surface to simulate the presence of a second (paired) directional sensor element. Such an image derived differential (IDD) microphone (or a microphone array made up of several such IDD microphones) provides a convenient mechanism for obtaining a directional microphone with advantageous response characteristics. (See, also, "Image-derived Second-order Differential Microphones" by G. W. Elko et al., Journal of the Acoustical Society of America, vol. 95, No. 4, 1994, pp. 1991–1997.) U.S. Pat. No. 4,965,775 and "Image-derived Second-order Differential Microphones" are hereby incorporated by reference as if fully set forth herein.

It would be desirable, therefore, to incorporate IDD microphones into portable computing devices such as notebook computers or hand-held tablet computers. However, since an IDD microphone requires that a sensor element be positioned a given distance from a reflecting surface, conventional approaches to incorporating an IDD microphone into such devices would invariably take up a significant amount of valuable space in the housing of the device, and may even require a substantial redesign of the device housing structure.

SUMMARY OF THE INVENTION

We have recognized that the space requirements for incorporating an IDD microphone or IDD microphone array into a portable computing device may be advantageously reduced by providing a mechanism by which an acoustic sensor unit (e.g., a first-order gradient microphone) extends or "pops out" to the desired spacing from the housing surface, and retracts to reduce its space requirements when the microphone is not in use. For example, in the case of a typical lap-top or notebook computer with a "flip-back" lid, the sensor element might, in accordance with one illustrative embodiment of the present invention, automatically extend to the desired position when the lid is opened, and automatically retract to be flush with the housing surface when the lid is closed.

Specifically, the present invention provides an acoustic signal receiving apparatus comprising a housing having an acoustically reflecting surface and a directional acoustic sensor unit having first-order gradient characteristics, where the sensor unit is coupled to the housing with use of a retractable member having a retracted position and an extended position. When the member is extended, the sensor unit is positioned relative to the reflecting surface such that the acoustic interaction between the sensor unit and the reflecting surface causes the output of the sensor unit to have second-order gradient response characteristics.

DETAILED DESCRIPTION

Figure 1A:
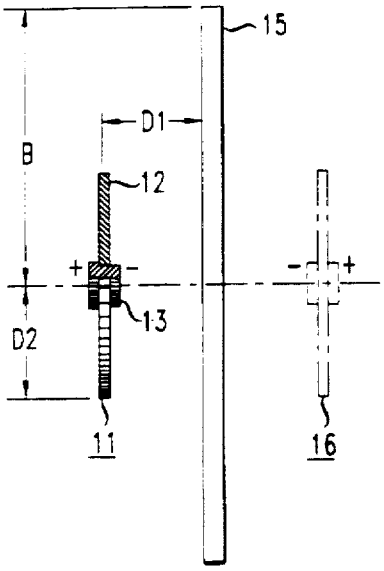
FIG. 1A (PRIOR ART)
FIGS. 1A and 1B show a conventional IDD microphone having second-order gradient characteristics composed of a first-order gradient sensor unit positioned over a reflecting plane.
Figure 1B:
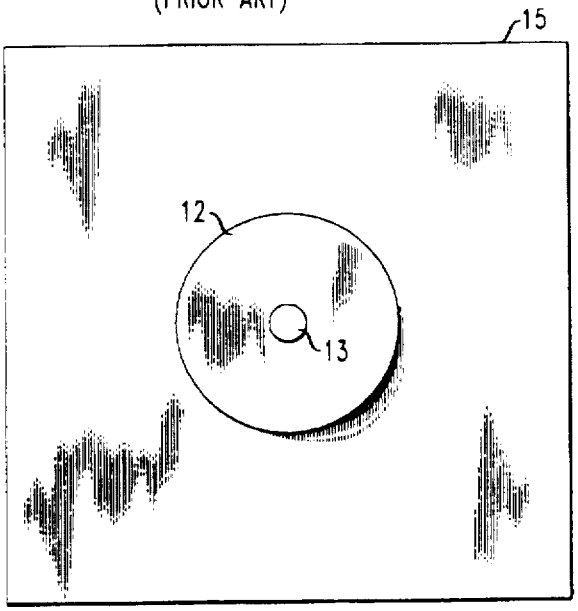
FIG. 1B (PRIOR ART)

FIGS. 1A and 1B show a conventional IDD microphone having second-order gradient characteristics composed of a first-order gradient sensor unit positioned over a reflecting plane. (FIG. 1A shows a side view and FIG. 1B shows a "head-on" view.) In particular, the IDD microphone of FIGS. 1A and 1B comprises directional microphone assembly 11 and reflecting plane 15. Directional microphone assembly 11, in turn, comprises a single first-order gradient acoustic sensor 13, which is advantageously cemented into an opening at the center of baffle 12. Acoustic sensor 13 may, for example, comprise a commercially available first-order differential (FOD) microphone such as a Panasonic model WM-55D103. Illustratively, baffle 12 is disc-shaped with a radius of D2, as shown in FIG. 1A. Directional microphone assembly 11 is advantageously positioned a predetermined distance from reflecting plane 15, shown in FIG. 1A as D1. The dotted lines in FIG. 1A show the effective "location" of phantom microphone assembly 16, which embodies the acoustic effect of the reflection of the FOD microphone off of reflecting plane 15. The "+" and "–" indicators show the relative phasing of the actual FOD microphone (i.e., microphone assembly 11) and that of the reflection (i.e., phantom microphone assembly 16).

As is known by those skilled in the art (see, e.g., U.S. Pat. No. 4,965,775 referenced above), the baffle around the FOD microphone advantageously provides an additional path length D2 around the microphone to improve the sensitivity thereof. (As the baffle length increases, the microphone sensitivity increases. In particular, the baffled FOD microphone's response will peak at Lambda=D2/2 and will cancel at Lambda=D2. Note also that the effective baffle dimension is determined by the shortest distance between the two ports of the FOD microphone.)

In addition, it is known that the separation from the reflecting plane D1 sets the upper cut-off frequency of the system, and, therefore, determines the usable bandwidth. (Output will peak at Lambda=D1/4 and will cancel at Lambda=D1/2.) For example, setting D1 to 2.5 cm will cause cancellation at 6,880 Hz and a peak at 3,440 Hz providing a usable frequency range to about 4 kHz. (Note that the reflecting plane begins to lose effectiveness when the wavelength of incident sound approaches the dimension of the baffle. If the FOD microphone is not located in the center of the plane, the effective dimension is the distance from the FOD microphone to the nearest edge. Again, the shortest distance is the determining factor.) A complete analysis of an IDD microphone such as that shown in FIGS. 1A and 1B can be found, for example, in "Image-derived second-order differential microphones" by G. W. Elko et al., referenced above. It is to be understood that wherever a single microphone is described herein, it will be obvious to those skilled in the art that multiple microphones in the form of microphone arrays may be similarly used.

In accordance with certain illustrative embodiments of the present invention, reduced storage volume for an IDD microphone may be achieved by providing a mechanism by which the FOD microphone assembly (i.e., the acoustic sensor and the surrounding baffle) can "pop-up" (i.e., extend) to a predetermined position, thereby achieving the desired spacing from the reflecting plane. Such a mechanism may, in various ones of these illustrative embodiments, operate either "manually" or "automatically."

In manually operable embodiments, the FOD microphone assembly may be extended to the desired spacing by, for example, the operation of a push button or a switch, or by merely physically pulling (or pushing) the FOD microphone assembly into the desired position. The operation of a push button or switch may, for example, operate to release a mechanical latch, thereby allowing the FOD microphone assembly to extend to the desired position as a result of a spring-loaded or other similar mechanism. Various detailed mechanical implementations for each of these approaches will be obvious to those of ordinary skill in the art. Each of these manual approaches may be advantageously used, for example, in a hand-held tablet computer as well as in a notebook or lap-top computer having a flip-back cover.

In automatically operable embodiments, the FOD microphone assembly may, for example, illustratively "pop-up" to the desired position automatically, again as a result of a spring-loaded or other similar mechanism. In one embodiment, such an automatic extension of the FOD microphone assembly may illustratively occur upon the opening of the flip-back cover of a notebook or lap-top computer, wherein spring tension is released when the cover is opened. In another such automatic embodiment, mechanical hinges may be arranged so as to cause the FOD microphone assembly to automatically move to the desired position upon the opening of the flip-back cover. In yet another such automatic embodiment, voice activated commands could be employed to release a mechanical latch in a manner similar to that described above for the manually operated push button or switch. Again, various detailed mechanical implementations for each of these approaches will be obvious to those of ordinary skill in the art.

Similarly, a corresponding mechanism may be provided whereby the FOD microphone assembly retracts (e.g., to reduce storage volume requirements), either manually or automatically, as well. For example, in a manually operable embodiment, the FOD microphone assembly may be made also to retract as a result of the operation of a push button or a switch, or by merely physically pushing (or pulling) the FOD microphone assembly back into its original (i.e., retracted) position. In one automatic embodiment, the FOD microphone assembly may, for example, illustratively retract into its reduced storage position as a natural consequence of the closing of the cover of a notebook computer as a result of the aforementioned spring tension being applied when the cover is closed. In another automatic embodiment, the FOD microphone assembly may, for example, also retract into its reduced storage position when the cover is closed, but merely as a result of an arrangement of mechanical hinges. And, again, in still other embodiments, voice activated commands may be used to activate a mechanism such as those described above (e.g., by a push button or a switch), which in turn causes the FOD microphone to retract. Once again, various detailed mechanical implementations for each of these approaches will be obvious to those of ordinary skill in the art.

FIGS. 2–5 present various illustrative embodiments of the present invention. FIGS. 2A and 2B show a first illustrative embodiment of the present invention wherein a collapsible IDD microphone is built into a notebook computer having a flip-back cover. (FIG. 2A shows a front view and FIG. 2B shows a side view.) Specifically, FOD microphone assembly 23, which comprises an acoustic sensor and a surrounding baffle, is located at the hinge which connects the bottom edge of flip-back cover 22 to the top edge of base 21 of a notebook or lap-top computer. As is common in conventional notebook computers, base 21 may include a processor and a keyboard (or other input device) therein, and flip-back cover 22 may include a display screen (or other output device) therein. FOD microphone assembly 23 is itself advantageously hinged to base 21 and to baffle extension 24, which is, in turn, hinged to cover 22. In this manner, upon the opening of cover 22, FOD microphone assembly 23, which had been fully collapsed when the notebook computer was closed, automatically extends to a desired position relative to (i.e., a predetermined distance from) the housing. Moreover, when cover 22 is closed, FOD microphone assembly 23 automatically collapses back into the housing. Cover 22 (which may include the aforementioned display screen) advantageously serves as a reflecting plane, which, in combination with FOD microphone assembly 23 so positioned, thereby effectuates an IDD microphone. Advantageously, baffle extension 24 is acoustically transparent and all air holes between the base and the cover are sealed by the hinge which connects them.

Figure 2A:
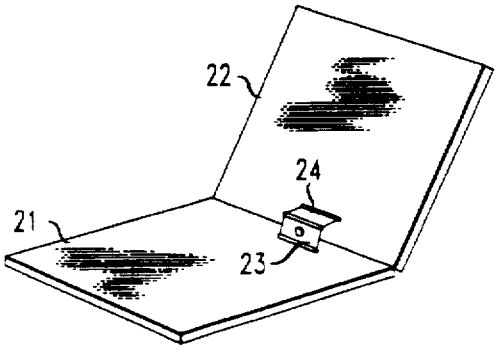
FIGS. 2A and 2B show a first illustrative embodiment of the present invention wherein a collapsible IDD microphone is built into a notebook computer having a flip-back cover.
Figure 2B:
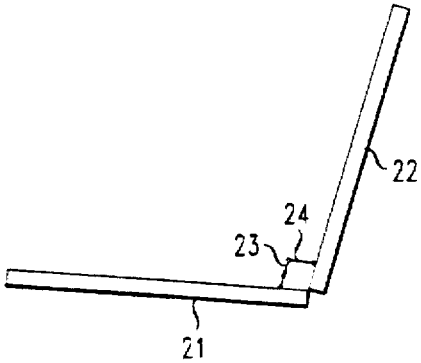
Figure 3A:
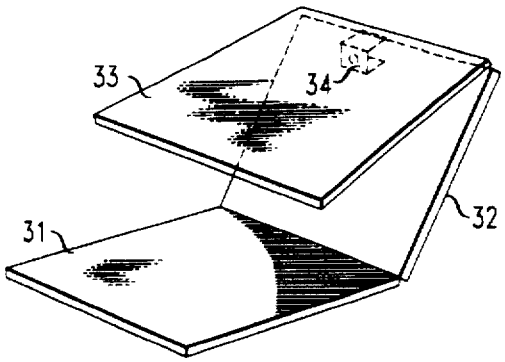
FIGS. 3A, 3B and 3C show a second illustrative embodiment of the present invention wherein a collapsible IDD microphone is built into a notebook computer having a doubly folded cover, thereby providing for enhanced microphone performance.
Figure 3B:
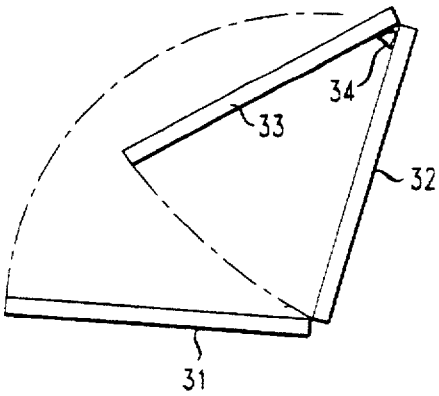
Figure 3C:
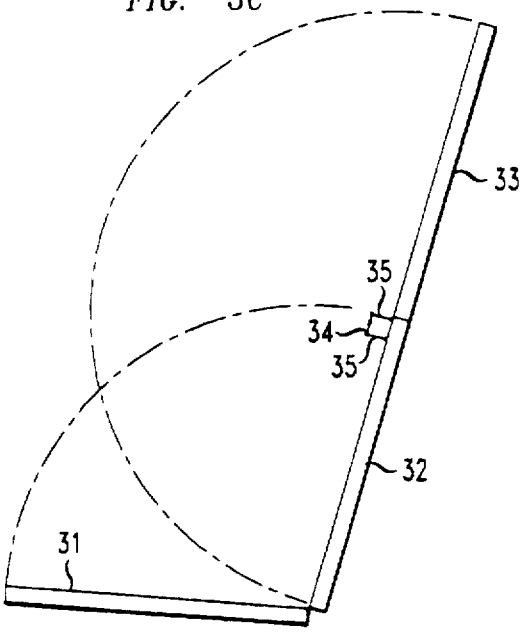

FIGS. 3A, 3B and 3C show a second illustrative embodiment of the present invention wherein a collapsible IDD microphone is built into a notebook computer having a doubly folded cover, thereby providing for enhanced microphone performance. (FIG. 3A shows a front view, FIG. 3B shows a side view, and FIG. 3C shows a side view with the doubly folded cover fully extended.) Since notebook computers are typically by their very nature small compared to the acoustic wavelength of normal voice signals (especially at low frequencies), the use of an extendable reflecting plane above the cover of the notebook computer of FIGS. 2A and 2B may be desirable. In particular, the use of such an extendable reflecting plane can enlarge the effective baffle size, thus improving the directional characteristics of the resultant IDD microphone.

Therefore, like the illustrative notebook computer of FIGS. 2A and 2B, the illustrative notebook computer of FIGS. 3A-3C comprises base 31 (which may include a keyboard or other input device therein), the top edge of which is hinged to the bottom edge of flip-back cover 32 (which may include a display screen or other output device therein). In addition, however, the notebook computer of FIGS. 3A-3C also comprises flip-up cover extension 33, the bottom edge of which is hinged to the top edge of cover 32. Moreover, FOD microphone assembly 34 (which, like FOD microphone assembly 23 of the notebook computer of FIGS. 2A and 2B, comprises an acoustic sensor and a surrounding baffle) is located at the hinge which connects the bottom edge of flip-up cover extension 33 to the top edge of flip-back cover 32. In this case, however, FOD microphone assembly 34 is itself advantageously hinged to two baffle extensions 35, each of which is, in turn, hinged to cover 32. In this manner, upon the opening of flip-up cover extension 33, FOD microphone assembly 34, which had been fully collapsed when the notebook computer was closed (i.e., when flip-up cover extension 33 was folded into cover 32), automatically extends to a desired position relative to (i.e., a predetermined distance from) the housing. Moreover, when cover extension 33 is closed (i.e., folded back into cover 32), FOD microphone assembly 34 automatically collapses back into the housing.

In the illustrative notebook computer of FIGS. 3A–3C, cover 32 and cover extension 33 advantageously combine to serve as a reflecting plane of increased size (relative to that of the notebook computer of FIG. 2A and 2B, for example), which, in combination with FOD microphone assembly 34 so positioned, thereby effectuates an IDD microphone having improved low frequency directional characteristics. Note that flip-up cover extension 33 may be advantageously folded either to the front of cover 32 (as shown), or to the back of cover 32, and may be transparent to allow the use of a display screen included in cover 32 when it is folded to the front. Of course, when cover extension 33 is folded to the front of cover 32, FOD microphone assembly 34 is collapsed back into the housing, thereby precluding the use of the IDD microphone.

Figure 4A:
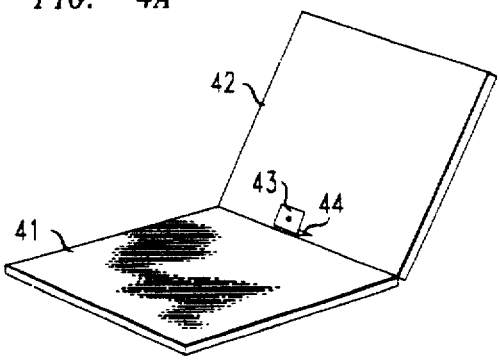
FIGS. 4A and 4B show a third illustrative embodiment of the present invention wherein a collapsible IDD microphone built into a notebook computer may be operated manually.
Figure 4B:
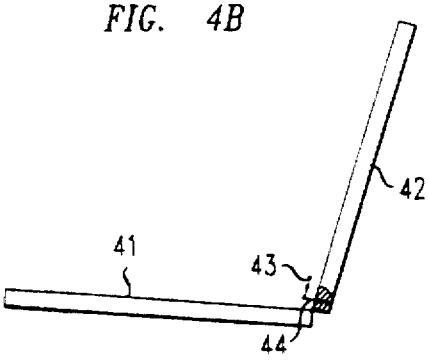

In addition, the illustrative notebook computer of FIGS. 3A–3C may be augmented by providing a thin dipole loudspeaker which is placed in cover extension 33 near the IDD microphone. Specifically, the loudspeaker may be advantageously positioned such that each transducer (i.e., the IDD microphone and the loudspeaker) is within the null (i.e., the area of little or no sensitivity) of the other. Such a directional loudspeaker advantageously results in reduced interference with neighbors (e.g., people who are not positioned directly in front of the computer.) FIGS. 4A and 4B show a third illustrative embodiment of the present invention wherein a collapsible IDD microphone built into a notebook computer may be operated manually. (FIG. 4A shows a front view and FIG. 4B shows a side view.) Like the illustrative notebook computer of FIGS. 2A and 2B, the illustrative notebook computer of FIGS. 4A and 4B comprises base 41 (which may include a keyboard therein), the top edge of which is hinged to the bottom edge of flip-back cover 42 (which may include a display screen therein). The illustrative notebook computer of FIGS. 4A and 4B, however, comprises a manually extendable and retractable FOD microphone assembly. In particular, FOD microphone assembly 43 (which, like FOD microphone assembly 23 of the notebook computer of FIGS. 2A and 2B, comprises an acoustic sensor and a surrounding baffle) is attached at a substantially right angle to bracket 44. Bracket 44 is mechanically coupled to cover 42 (also at a substantially right angle) so that it may be manually extended (e.g., pulled out) to a predetermined position when an IDD microphone is needed, and may be manually retracted (e.g., pushed back) into cover 42 for storage. When bracket 44 is fully extended, FOD microphone assembly 43 is advantageously positioned relative to cover 42 (which may include the aforementioned display screen) so that cover 42 serves as a reflecting plane, which, in combination with FOD microphone assembly 43 so positioned, thereby effectuates an IDD microphone.

Figure 5A:
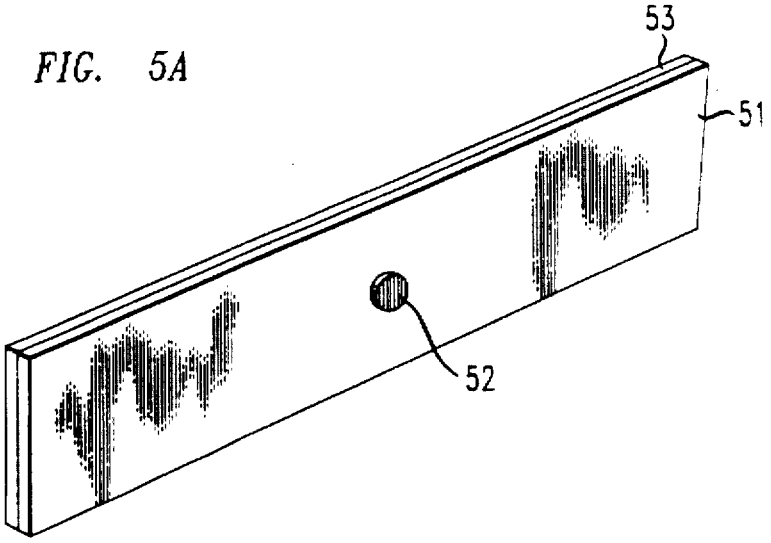
FIGS. 5A, 5B and SC show a fourth illustrative embodiment of the present invention wherein a collapsible IDD microphone may advantageously use its baffle as part of the mounting system.
Figure 5B:
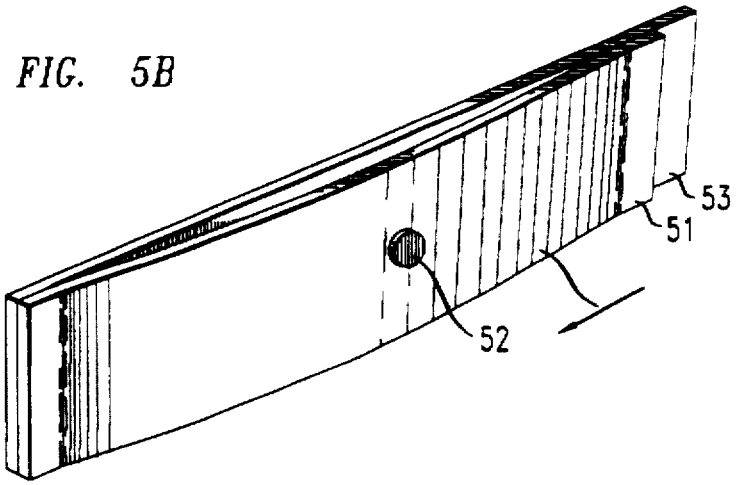
Figure 5C:
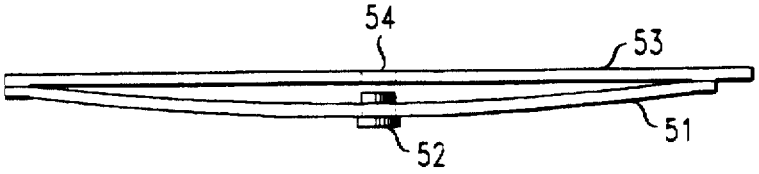

FIGS. 5A, 5B and 5C show a fourth illustrative embodiment of the present invention wherein a collapsible IDD microphone may advantageously use its baffle as part of the mounting system. (FIG. 5A shows a front view wherein the IDD microphone is retracted for storage, and FIGS. 5B and 5C show a front view and a top view, respectively, wherein the IDD microphone is extended for use.) That is, the baffle itself serves as the retractable member which positions the sensor unit in either its extended or retracted position.

Specifically, first-order gradient acoustic sensor 52 is mounted in an opening in baffle 51, thereby resulting in a FOD microphone assembly. Baffle 51, which is advantageously flexible, is mounted on surface 53, being fixed at a first end (e.g., the left end) of the baffle, and slidable at a second end (e.g., the right end) of the baffle. In this manner, the FOD microphone assembly may be extended to a desired (e.g., a predetermined) distance from mounting surface 53 by moving the slidable end towards the fixed end, or it may be retracted so as to be flush therewith by moving the slidable end away from the fixed end. Surface 53 is an acoustically reflecting surface which may, for example, comprise a surface of an apparatus such as a computer system, or which may be attached to the housing of such an apparatus. (Note in FIG. 5C that first-order order gradient acoustic sensor 52 may advantageously fit into an appropriately located opening in surface 53 when baffle 51 is flush therewith.) When the FOD microphone assembly comprising baffle 51 and first-order gradient acoustic sensor 52 is extended, mounting surface 53 acts as a reflecting plane, and the combination of the reflecting plane and the FOD microphone assembly, so positioned, effectuates an IDD microphone in accordance with this fourth illustrative embodiment of the present invention.

In other embodiments of the present invention, a plurality of sensors (e.g., FOD microphones) may be mounted in corresponding openings along the flexible baffle (i.e., baffle 51) of the illustrative IDD microphone assembly of FIGS. 5A, 5B and 5C to form an IDD microphone array. In addition, non-uniform spacing between the FOD microphones and the acoustically reflecting surface may advantageously be used to provide one or more lower frequency IDD microphones and one or more higher frequency IDD microphones, thereby extending the overall frequency range of the system. (Recall that the distance between the FOD microphone and the reflecting plane sets the upper cut-off frequency.) Conventional cross-over circuits, familiar to those of ordinary skill in the art, may be added to take full advantage of such an arrangement.

In some situations (e.g., quiet, non-reverberant locations) it may not be necessary to make use of an IDD microphone. Moreover, it may be desirable in some of these situations to provide a more extended frequency range than would be available with use of an IDD microphone. In such situations, the microphone may be used in its stored (or collapsed) position, since the sensor is likely to have a broader frequency response in its collapsed position. An alternative set of filters to correct for the difference in the frequency response of the microphone may be advantageously employed for this operational mode. (Such filters are familiar to those skilled in the art.) Moreover, in these or other similar situations, the microphone could be advantageously retracted so that the back port is closed, thereby converting a FOD microphone to an omnidirectional microphone, if such a response characteristic is deemed to be desirable.

Although a number of specific embodiments of this invention have been shown and described herein, it is to be understood that these embodiments are merely illustrative of the many possible specific arrangements which can be devised in application of the principles of the invention. For example, although the above-described embodiments have been shown as using a single IDD microphone (i.e., a single acoustic sensor), an IDD microphone array employing multiple sensors may be used in a completely analogous manner. In addition, many alternative mechanisms for the automatic or manual extension and retraction of the FOD microphone assembly may be employed, each of these obvious to one of ordinary skill in the art.

Moreover, even though the above-described embodiments have been described in the context of a portable computing device, an IDD microphone in accordance with the present invention may be used in many other devices, including, but not limited to, desk-top (as opposed to portable) computer systems and either portable or desk-top telecommunications devices. For example, in one illustrative embodiment of the present invention, an IDD microphone in accordance with the present invention may be provided in a cellular flip phone (i.e., a compact portable cellular phone whose mouthpiece section flips forward for use) in an analogous manner to that of the illustrative notebook computer shown in FIGS. 2A and 2B and described above. Specifically, the flip-forward mouthpiece of such a cellular flip phone embodiment serves as the acoustically reflecting cover to which the FOD microphone assembly may be attached. In addition, the FOD microphone assembly may, for example, automatically extend upon the opening of the flip-forward mouthpiece and automatically retract upon its closing. In addition to the above-described embodiments and alternative embodiments, numerous and varied other arrangements can be devised in accordance with the principles of the present invention by those of ordinary skill in the art without departing from the spirit and scope of the invention.

We claim:

1. An acoustic signal receiving apparatus comprising a housing having an acoustically reflecting surface; and a directional acoustic sensor unit having a first-order gradient response characteristic, the sensor unit mechanically coupled to the housing with use of a retractable member having a retracted position and an extended position, such that, when the member is in the extended position, the sensor unit is positioned relative to the reflecting surface wherein acoustic interaction between the sensor unit and the reflecting surface causes an output of the sensor unit to have a second-order gradient response characteristic.

2. The apparatus of claim 1 wherein the housing is the housing of a computer system.

3. The apparatus of claim 2 wherein the computer system is a portable computing device.

4. The apparatus of claim 1 wherein the housing is the housing of a telecommunications device.

5. The apparatus of claim 4 wherein the telecommunications device comprises a portable flip phone.

6. The apparatus of claim 1 wherein the sensor unit comprises a directional microphone and a baffle attached thereto.

7. The apparatus of claim 1 wherein the sensor unit comprises a plurality of directional microphones and a baffle attached to each of said directional microphones.

8. The apparatus of claim 7 wherein a first one of said plurality of directional microphones is positioned at a first distance relative to the reflecting surface when the retractable member is in the extended position, and wherein a second one of said plurality of directional microphones is positioned at a second distance relative to the reflecting surface when the retractable member is in the extended position, said first distance and said second distance being unequal.

9. The apparatus of claim 1 wherein the retractable member comprises a baffle attached to the sensor unit.

10. The apparatus of claim 9 wherein the sensor unit comprises a plurality of directional microphones.

11. The apparatus of claim 10 wherein a first one of said plurality of directional microphones is positioned at a first distance relative to the reflecting surface when the retractable member is in the extended position, and wherein a second one of said plurality of directional microphones is positioned at a second distance relative to the reflecting surface when the retractable member is in the extended position, said first distance and said second distance being unequal.

12. The apparatus of claim 1 further comprising a loudspeaker, the loudspeaker positioned relative to the sensor unit such that, when the retractable member is in the extended position, the loudspeaker is located in a null region of said second-order gradient response characteristic.

13. The apparatus of claim 12 wherein the loudspeaker comprises a dipole loudspeaker.

14. The apparatus of claim 1 wherein the retractable member is mechanically coupled to an elastic spring having tension when in a compressed state thereof.

15. The apparatus of claim 14 wherein the retractable member is adapted to attain its extended position when the tension is released from the elastic spring.

16. The apparatus of claim 14 wherein the retractable member is adapted to attain its retracted position when the tension is released from the elastic spring.

17. The apparatus of claim 1 wherein the retractable member is mechanically coupled to the housing with use of one or more hinges.

18. The apparatus of claim 1 wherein the housing includes a base unit and a cover having an opened position and a closed position with respect to the base unit, the cover mechanically coupled to the base unit with use of a hinge, the cover having an acoustically reflecting surface.

19. The apparatus of claim 18 wherein the sensor unit comprises a directional microphone and a baffle attached thereto.

20. The apparatus of claim 18 wherein the sensor unit comprises a plurality of directional microphones and a baffle attached to each of said directional microphones.

21. The apparatus of claim 20 wherein a first one of said plurality of directional microphones is positioned at a first distance relative to the reflecting surface when the retractable member is in the extended position, and wherein a second one of said plurality of directional microphones is positioned at a second distance relative to the reflecting surface when the retractable member is in the extended position, said first distance and said second distance being unequal.

22. The apparatus of claim 18 wherein the retractable member is adapted to attain its extended position whenever the cover is placed in its open position and adapted to attain its retracted position whenever the cover is placed in its closed position.

23. The apparatus of claim 22 wherein the retractable member is mechanically coupled to an elastic spring having tension in a compressed state thereof, and wherein the tension is released from the elastic spring when the cover is placed in its open position and wherein the tension is applied to the elastic spring when the cover is placed in its closed position.

24. The apparatus of claim 22 wherein the retractable member is mechanically coupled to the housing with use of one or more hinges adapted to place the retractable member in its extended position whenever the cover is placed in its open position and adapted to place the retractable member in its retracted position whenever the cover is placed in its closed position.

25. The apparatus of claim 18 wherein the housing further comprises a cover extension having an opened position and a closed position with respect to the cover, the cover extension mechanically coupled to the cover with use of a hinge, and wherein the retractable member is adapted to attain its extended position whenever the cover extension is placed in its open position and adapted to attain its retracted position whenever the cover extension is placed in its closed position.

26. The apparatus of claim 25 wherein the retractable member is mechanically coupled to an elastic spring having tension in a compressed state thereof, and wherein the tension is released from the elastic spring when the cover extension is placed in its open position and wherein the tension is applied to the elastic spring when the cover extension is placed in its closed position.

27. The apparatus of claim 25 wherein the retractable member is mechanically coupled to the housing with use of one or more hinges adapted to place the retractable member in its extended position whenever the cover extension is placed in its open position and adapted to place the retractable member in its retracted position whenever the cover is placed in its closed position.

28. The apparatus of claim 25 further comprising a loudspeaker, the loudspeaker attached to the cover extension and positioned relative to the sensor unit such that, when the retractable member is in the extended position, the loudspeaker is located in a null region of said second-order gradient response characteristic.

29. The apparatus of claim 28 wherein the loudspeaker comprises a dipole loudspeaker.

30. A portable computing device comprising a processor;

input device which provides input to the processor from a user;

an output device which provides output from the processor to the user;

a housing having an acoustically reflecting surface; and a directional acoustic sensor unit having first-order gradient response characteristics, the sensor unit mechanically coupled to the housing with use of a retractable member having a retracted position and an extended position, such that, when the member is in the extended position, the sensor unit is positioned relative to the reflecting surface whereby acoustic interaction between the sensor unit and the reflecting surface causes an output of the sensor unit to have a second-order gradient response characteristic.

* * * * *